US011339592B2

(12) United States Patent
Cartier et al.

(10) Patent No.: US 11,339,592 B2
(45) Date of Patent: May 24, 2022

(54) LOCKING MECHANISM FOR SLIDING DOOR SYSTEM

(71) Applicant: TECHNOLOGIES LANKA INC., La Pocatiere (CA)

(72) Inventors: Paul Cartier, Saint-Anne-de-la-Pocatiere (CA); Jean-Paul Dionne, Levis (CA); Gaston Roy, Quebec (CA); Andreas Schunke, Hardegsen (DE)

(73) Assignee: TECHNOLOGIES LANKA INC., Quebec (CA)

( * ) Notice: Subject to any disclaimer, the term of this patent is extended or adjusted under 35 U.S.C. 154(b) by 791 days.

(21) Appl. No.: 16/307,076

(22) PCT Filed: Jun. 5, 2017

(86) PCT No.: PCT/CA2017/050678

§ 371 (c)(1),
(2) Date: Dec. 4, 2018

(87) PCT Pub. No.: WO2017/210776

PCT Pub. Date: Dec. 14, 2017

(65) Prior Publication Data

US 2019/0330888 A1 Oct. 31, 2019

Related U.S. Application Data

(60) Provisional application No. 62/347,854, filed on Jun. 9, 2016.

(51) Int. Cl.
*E05B 85/26* (2014.01)
*E05F 15/60* (2015.01)
(Continued)

(52) U.S. Cl.
CPC ..... *E05B 85/26* (2013.01); *E05B 79/20* (2013.01); *E05B 83/363* (2013.01); *E05B 83/40* (2013.01);
(Continued)

(58) Field of Classification Search
CPC ..... E05B 85/26; E05B 83/40; E05B 83/363; E05B 79/20; E05F 15/60; E05Y 2900/531; E05Y 2900/51
See application file for complete search history.

(56) References Cited

U.S. PATENT DOCUMENTS 1,060,019 A * 4/1913 Pederson ..... E05C 19/022 292/99
1,739,897 A * 12/1929 Garber ..... E05F 17/001 49/17
(Continued)

FOREIGN PATENT DOCUMENTS

CA 2964792 A1 4/2016
GB 2046828 A * 11/1980 ..... E05F 15/565

OTHER PUBLICATIONS

International Search Report dated Aug. 22, 2017 of the corresponding International Application PCT/CA17/050678 filed Jun. 5, 2017.

*Primary Examiner* — Mark A Williams
(74) *Attorney, Agent, or Firm* — Norton Rose Fulbright US LLP; Gerard Messina

(57) ABSTRACT

The locking mechanism is adapted to a door system having a door unit slidably mounted to a door frame to open and close by sliding longitudinally along the door frame. The locking mechanism includes: a pivoting member pivotally mounted to one of the door frame and the door unit for pivoting about a pivot axis, and a hook member spaced apart from the pivot axis such that the hook member can pivot about the pivot axis via the pivoting member; and a guide member secured to the other one of the door frame and the
(Continued)

door unit, the guide member having a channel formed therein to receive the hook member when the pivoting member is moved toward the guide by said sliding of the door, and subsequently maintain engagement with the hook member.

11 Claims, 11 Drawing Sheets

(51) Int. Cl.
*E05B 79/20* (2014.01)
*E05B 83/36* (2014.01)
*E05B 83/40* (2014.01)

(52) U.S. Cl.
CPC ..... *E05F 15/60* (2015.01); *E05Y 2900/51* (2013.01); *E05Y 2900/531* (2013.01)

(56) References Cited

U.S. PATENT DOCUMENTS 1,840,623 A * 1/1932 Garber ..... E05F 17/001 49/20
1,962,844 A * 6/1934 Schneider ..... E05D 13/04 16/104
2,200,074 A * 5/1940 Bouton ..... B66B 13/165 187/318
2,869,183 A * 1/1959 Smith ..... E05D 13/006 49/322
3,774,342 A * 11/1973 Thom ..... E05D 15/066 49/420
3,879,893 A * 4/1975 Helmick ..... E05D 15/0665 49/420
4,805,262 A * 2/1989 Marshik ..... E05D 15/0691 16/105
4,822,084 A * 4/1989 Fox ..... E05B 65/0888 292/270
4,915,428 A * 4/1990 Hayakawa ..... E05B 65/0811 292/29
5,595,409 A 1/1997 Fier et al.
7,699,363 B2 4/2010 Langfermann et al.
2016/0083984 A1 3/2016 Hahnenberg et al.

* cited by examiner

LOCKING MECHANISM FOR SLIDING DOOR SYSTEM

FIELD OF THE INVENTION

The present invention relates to sliding door systems having door units slidably mounted to door frames to open and close by sliding longitudinally along the door frames, and more specifically to locking mechanisms of such sliding door systems.

BACKGROUND INFORMATION

Sliding door systems can be used on transit vehicles such as trains. Upon arrival of the transit vehicle at a destination, the sliding door systems of such transit vehicles are actuated to move their door units in an open position and let the passengers board and/or get off the transit vehicle. Once the boarding is completed, the door units are moved into a closed position, in which the door units are locked using dedicated locking mechanisms.

Although existing locking mechanisms for sliding door systems are satisfactory to a certain extent, there remains room for improvement.

SUMMARY OF THE INVENTION

In one aspect, there is described a locking mechanism for a door system which can lock a door unit in a closed position such that the door unit remains locked into the closed position even when a force is exerted to open the door unit.

In accordance with one aspect, there is provided a locking mechanism for a door system having a door unit slidably mounted to a door frame to open and close by sliding longitudinally along the door frame, the locking mechanism comprising: a pivoting member pivotally mounted to one of the door frame and the door unit for pivoting about a pivot axis, and a hook member spaced apart from the pivot axis such that the hook member can pivot about the pivot axis via the pivoting member; a guide member secured to the other one of the door frame and the door unit, the guide member having a channel formed therein to receive the hook member when the pivoting member is moved toward the guide by said sliding of the door, and subsequently maintain engagement with the hook member to force the pivoting of the hook member around the pivot axis passed a longitudinally-aligned position in which the hook member is longitudinally aligned with the pivot axis, and into a rest area of the channel as the door continues to be slid along the door frame, the channel having a sloping face in the rest area which engages the hook member and forces the hook member away from the longitudinally-aligned position if the door is subsequently slid in a reverse direction while the hook member is in the rest area.

Many further features and combinations thereof concerning the present improvements will appear to those skilled in the art following a reading of the instant disclosure.

DETAILED DESCRIPTION

Figure 1:
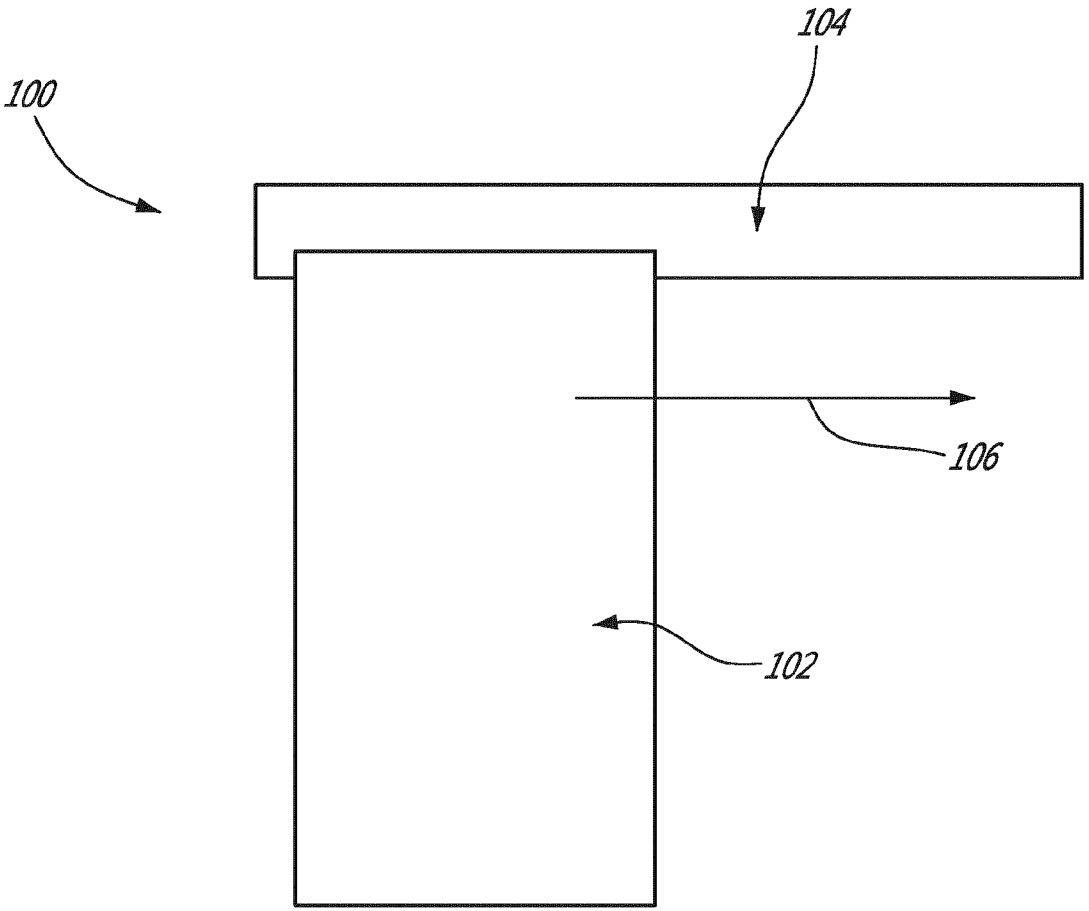
FIG. 1 is a schematic view of a sliding door system.

FIG. 1 shows an example of a sliding door system 100. A door unit 102 is slidingly mounted to a door frame 104 in a manner to allow sliding the door unit 102 along the door frame 104. The orientation along which the door unit 102 is slid along the door frame will be referred to herein as the longitudinal orientation 106, for convenience.

Figure 2A:
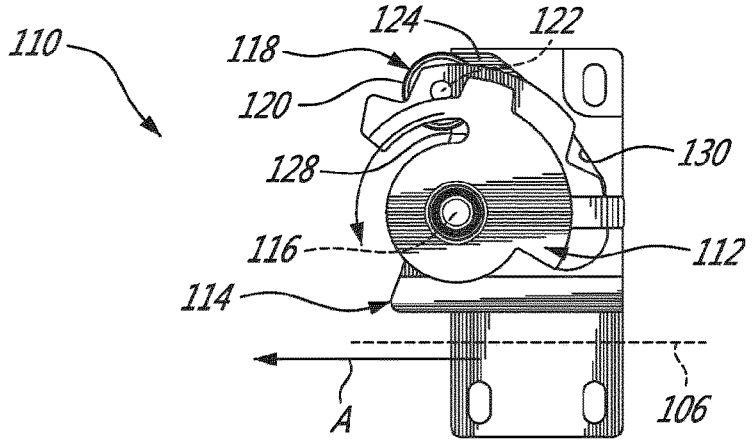
FIGS. 2A, 2B and 2C are successive views showing operation of the locking mechanism as the door unit is slid relatively to the door frame.
Figure 2B:
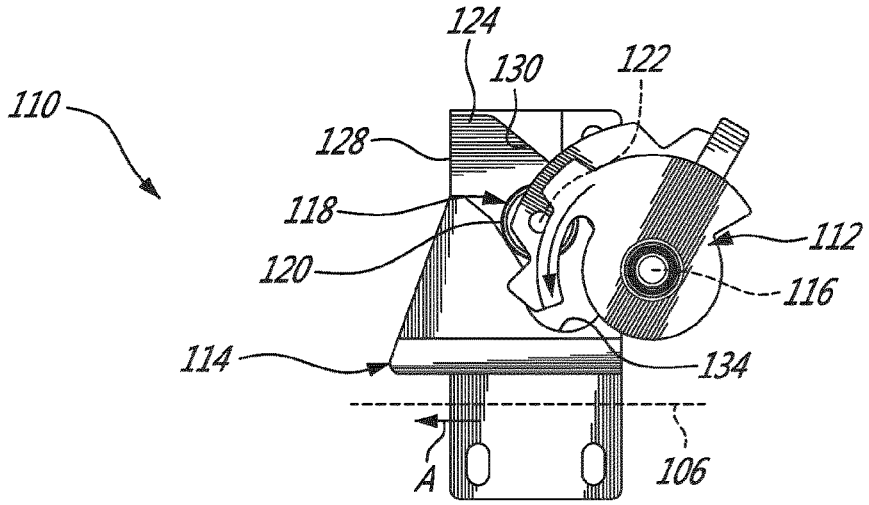
Figure 2C:
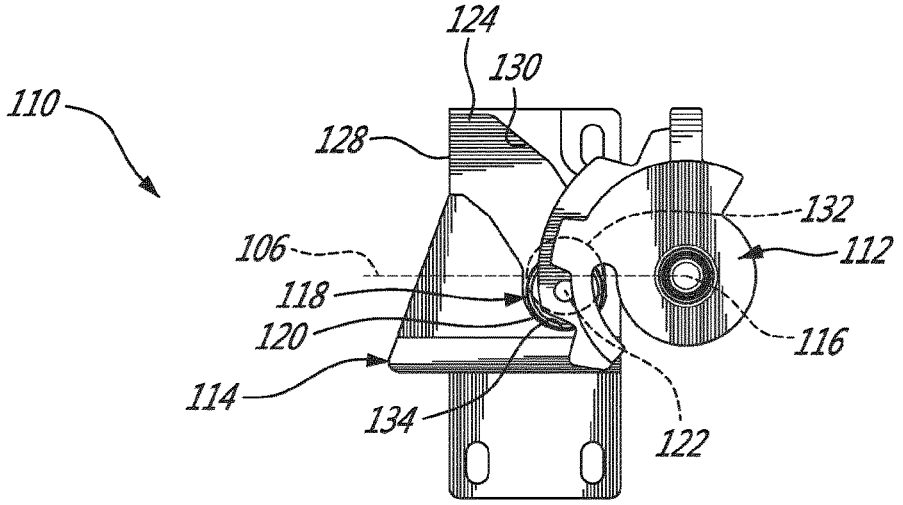

Such a sliding door system 100 can be provided with a locking mechanism. An example of a locking mechanism 110 is shown in FIGS. 2A to 2C, in which the locking mechanism 110 has two relatively moving parts, the pivoting member 112 and the guide member 114. One of the pivoting member 112 and the guide member 114 is mounted to the door unit 102 whereas the other one is mounted to the door frame 104 in a manner that when the door unit 102 is slid along the door frame 104, the pivoting member 112 and the guide member 114 are relatively moved towards or away from one another in the longitudinal orientation 106. The pivoting member 112 is pivotally mounted to pivot around a pivot axis 116, whereas the guide member 114 is secured and not pivotable. The pivoting member 112 has some form of hook member 118. In this example, the hook member 118 is provided in the form of a roller 120 which rotates around a rotation axis 122 and which is configured for engagement with a mating arcuate channel 124 formed in the guide member 114. In an alternate embodiment, the hook member 118 can be a pin, for instance. The locking mechanism 110 can be used to lock the door unit 102 in the closed position, for instance. Alternately, the locking mechanism 110 can be used to lock the door unit 102 in an open position.

Figure 3:
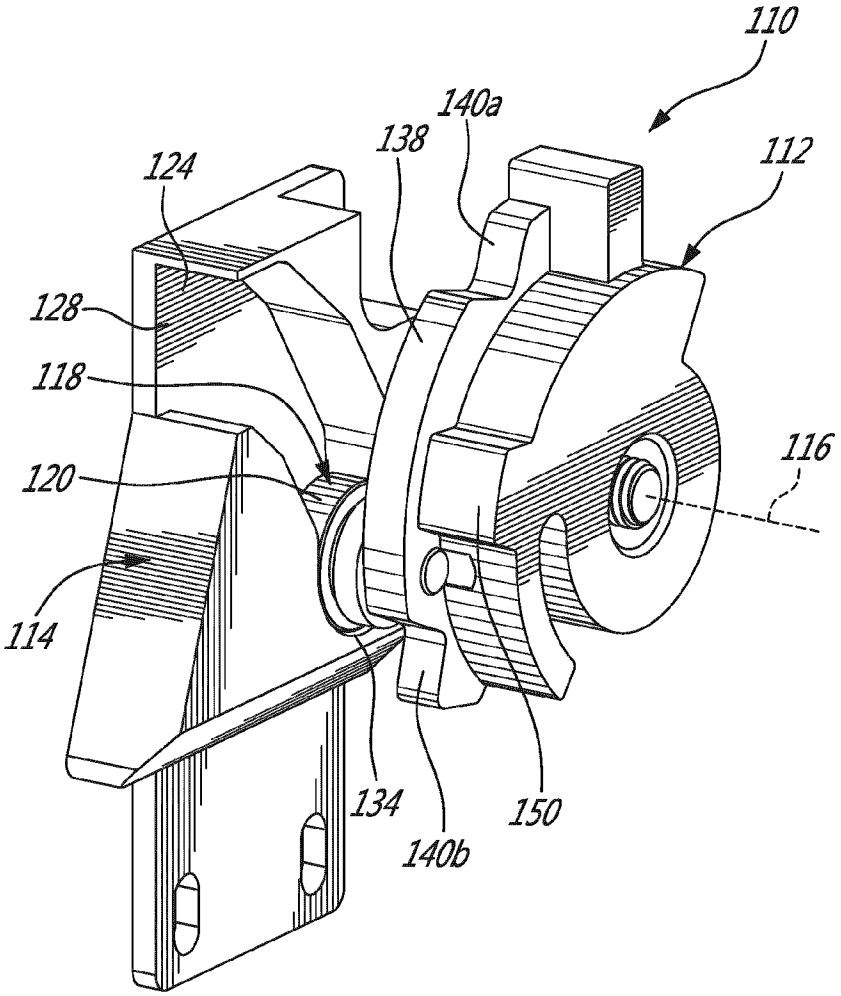
FIG. 3 is an oblique view of the locking mechanism.

The general operation of the locking mechanism 110 is as follows. As the door unit 102 is slid in a first direction A into the closed position, the roller 120 is brought into an open end 128 of the channel 124 as shown in FIG. 2A. As the door unit 102 is further slid, an outer guiding face 130 of the channel 124 slidingly engages the roller 120 and guides the roller 120 in a manner to force the pivoting of the roller 120, and of the pivoting member 112 onto which it is rotatably mounted, around the pivot axis 116, such as shown in FIG. 2B. The pivoting of the roller 120 continues and the roller 120 eventually reaches a position in which its rotation axis 122 is longitudinally-aligned with the pivot axis 116. This position will be referred to as the longitudinally-aligned position 132 and is shown as a dashed-line circle in FIG. 2C. In the longitudinally-aligned position, the roller 120 has still not reached an end of the channel 124 of the guide member 114, which will be referred to as the rest area 134, and so the pivoting movement of the roller 120 continues until it reaches the rest area 134 such as shown in FIG. 2C and FIG. 3. The rest area 134 is past the longitudinally-aligned position 132 along the length of the channel 124, opposite to the open end 128 of the channel 124.

Figure 4:
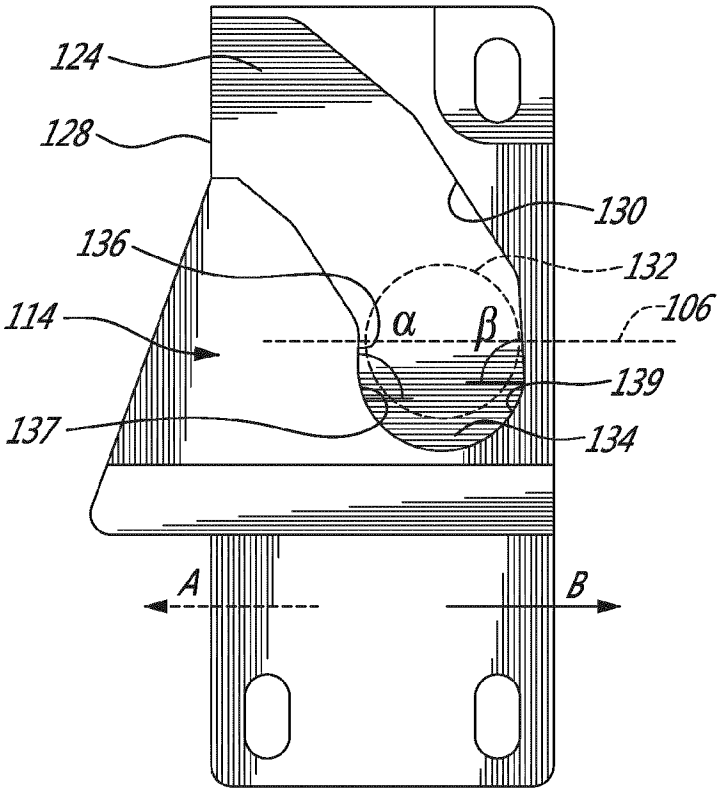
FIG. 4 is a front elevation view of a guide member of the locking mechanism.

As shown in FIG. 4, the channel 124 is provided with a sloping face 136 at the rest area 134 which acts as a catch. Indeed, if the door unit 102 is pulled open at this stage, i.e. in a reverse direction B opposite the first direction A, the sloping face 136 will push longitudinally against the roller 120 in the rest area 134, and effectively push the roller 120 in a direction opposite to the longitudinally-aligned position 132. In this example, the sloping face 136 is located along a radially-inner face 137 of the channel 124. To perform this function, the slope does not need to be particularly pronounced. An angle $\alpha$ between 85° and 90°, which may be less than 95°, from the longitudinal orientation 106 can be used, for instance. In the illustrated embodiment, the angle $\alpha$ is of 89°. Similarly, the extent to which the channel 124 exceeds the longitudinally-aligned position 132 can be limited. In order to allow movement of the door unit 102 back to the open position, the hook member 118 must first be moved out of the rest area 134. Various arrangements can be provided to perform this function depending on the application, and a few will be presented as examples further below. In this example, the roller 120 is a roller bearing, which was found satisfactory in this embodiment. Moreover, in this embodiment, even the final portion 139 of the outer guiding face 130 is sloping in a manner to guide the hook member 118 into the rest area 134, and the corresponding angle $\beta$ can be of 87° from the longitudinal orientation 106, for instance.

Figure 5A:
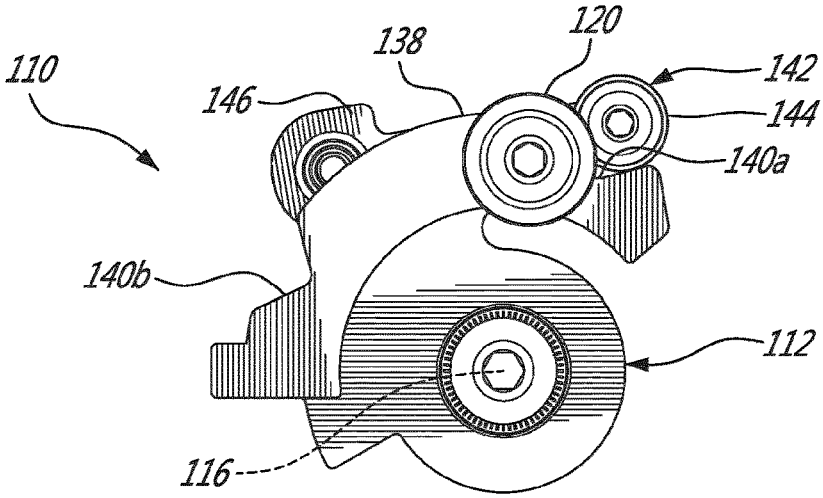
FIGS. 5A, 5B and 5C are successive views showing the operation of a biasing roller of the lock system.
Figure 5B:
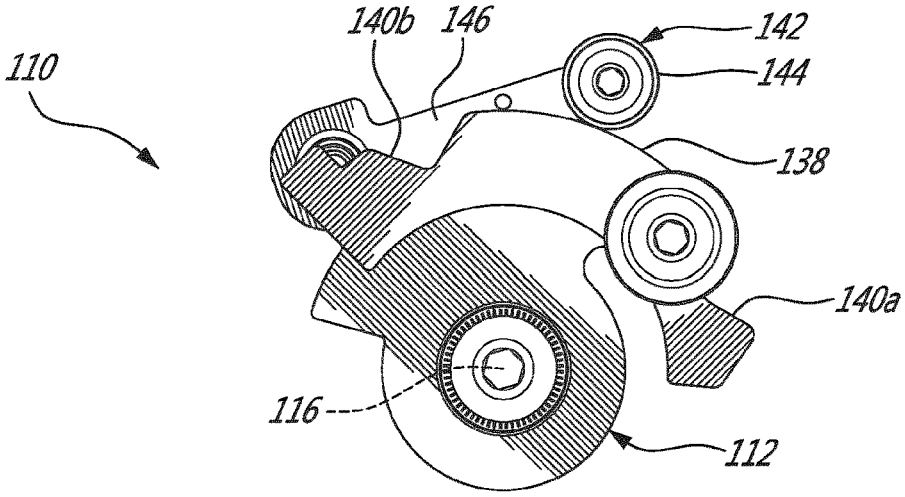
Figure 5C:
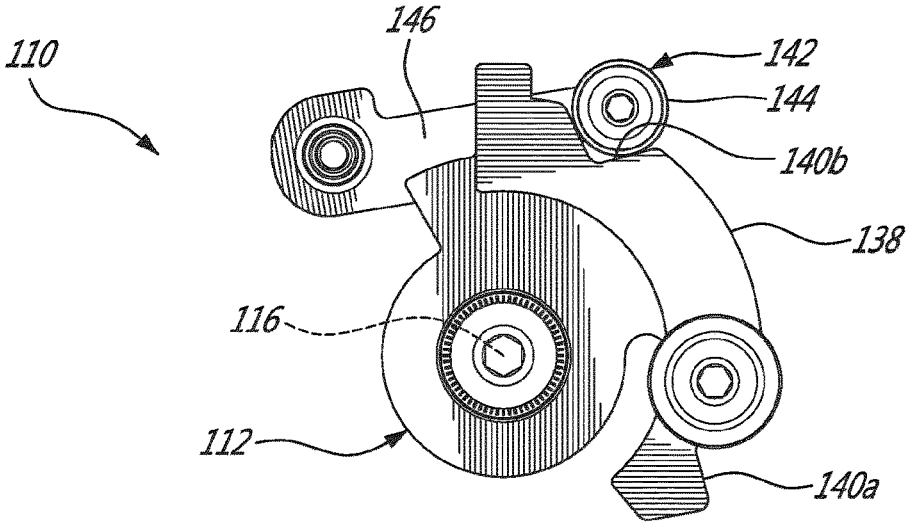

If the locking mechanism 110 is used in an environment subjected to vibrations or shock, such as a train car for instance, it can be desired to provide the locking mechanism 110 with an arrangement to bias the roller 120 into the rest area 134 against forces which can be generated by such vibrations or shock. Similarly, it can be desired to provide the locking mechanism 110 with an arrangement to maintain the angular position of the roller 120 when it exits the channel 124, to allow the roller 120 to easily engage the channel 124 when it returns. In the illustrated embodiment, both these latter functions are performed by a relatively simple subsystem. Indeed, as shown in FIG. 3, the pivoting member 112 is provided with an arcuate guide face 138 which is centered on the pivot axis 116. The arcuate guide face 138 is terminated at both ends by a corresponding notch 140*a* and 140*b*. Moreover, as shown in FIGS. 5A to 5C, the locking mechanism 110 is provided with a biasing member 142 which is abuts the arcuate guide face 138 and is biased towards the pivot axis 116. In this example, the biasing member 142 is a roller 144 which is rotatably mounted to the end of a lever arm 146, the lever arm 146 itself being pivotally mounted at its opposite end. A biasing element, such as a coil spring for instance, can be used to bias the biasing member 142 against the arcuate guide face 138 by pivotally biasing the lever arm 146.

In FIG. 5A, the pivoting member 112 is shown in the same angular position than in FIG. 2A, and the biasing member 142 is engaged with a first one of the two notches 140*a* and 140*b*. As the roller 120 engages the channel 124, the pivoting force generated by the outer guiding face 130 of the channel 124 against the pivoting member 112 overcomes the biasing force which maintains the biasing member 142 in the first notch 140*a*, and the biasing member 142 is pushed out from the first notch 140*a* as the pivoting member 112 pivots. The roller 144 of the biasing member 142 then rolls along the arcuate guide face 138 such as shown in FIG. 5B. When the hook member 118 reaches the rest area 134 such as shown in FIG. 2C, the roller 144 of the biasing member 142 reaches the other notch 140*b* such as shown in FIG. 5C, which biases the pivoting member 112 in the angular rest area 134 against outside forces such as vibrations. The arrangement for pivoting the hook member 118 out from the rest area 134 can be adapted to overcome this biasing force. Alternate embodiments can be provided with only a single one of the two notches 140*a* and 140*b*, for instance.

Figure 6A:
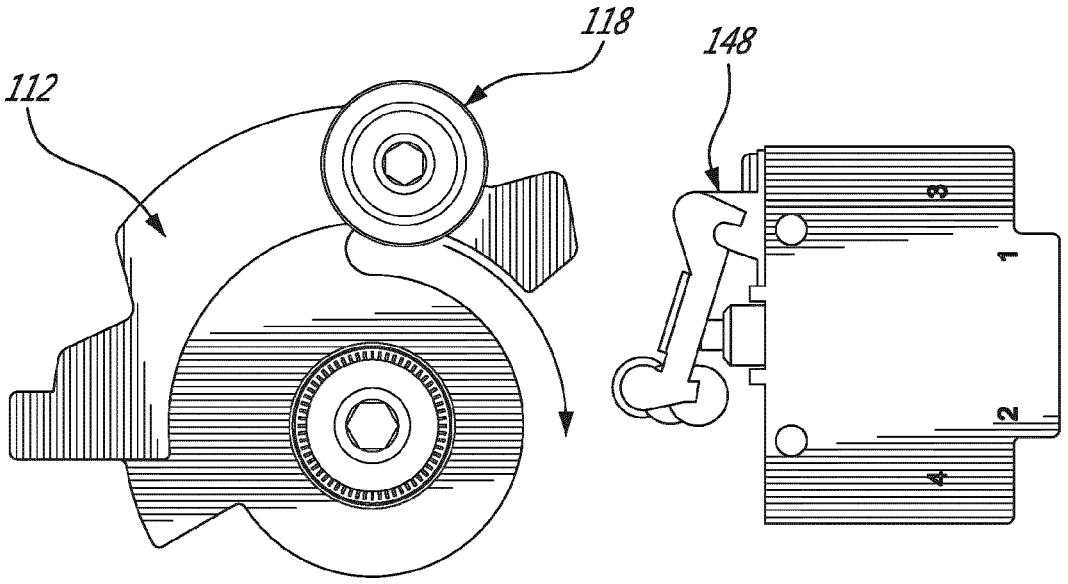
FIGS. 6A and 6B are successive views showing the operation of a limit switch triggered when the lock system is in a given circumferential position.
Figure 6B:
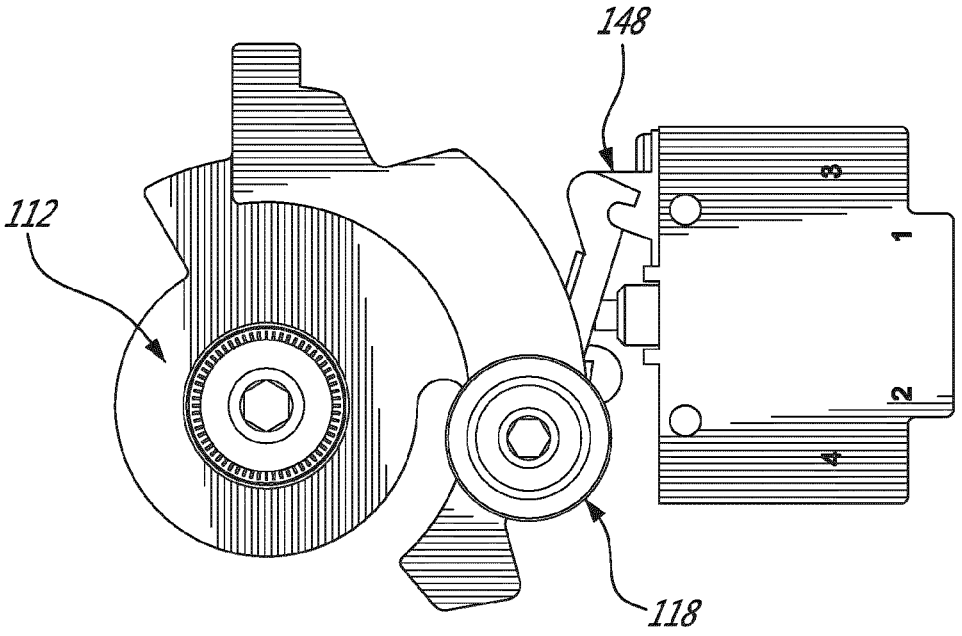

Turning now to FIGS. 6A and 6B, a limit switch 148 can be configured and positioned in a manner to be triggered when the pivoting member 112 reaches a given angular position. In the example shown, the limit switch 148 is positioned in a manner to be triggered when the hook member 118 is in the rest area 134. The limit switch 148 is triggered by a trigger 150 formed as part of the pivoting member 112, such as shown in FIG. 3. The signal from the limit switch 148 can be used to signal to a control system that the door unit 102 is locked, for instance. The control system can be a computerized which is adapted to automatically, or semi-automatically control the motorized opening and closing of the door unit, for instance. If a plurality of door units is used in successive cars of a train, for instance, the engineer can wait for a signal indicating that all the door units are locked prior to accelerating.

Figure 7A:
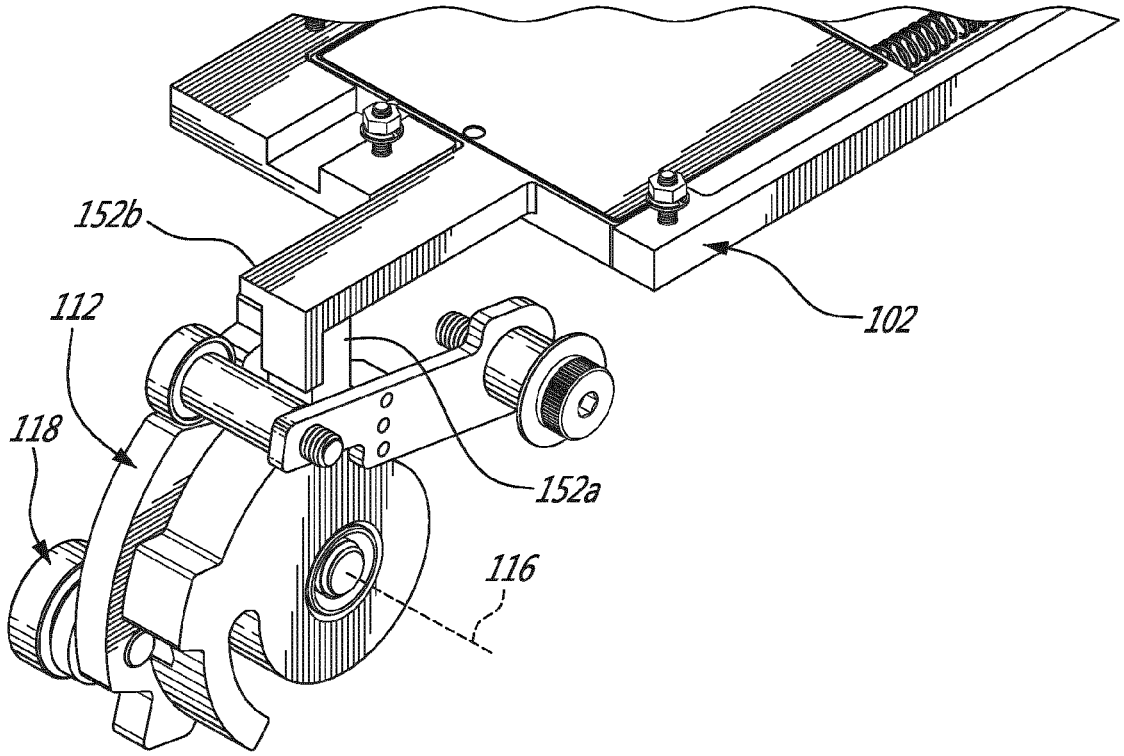
FIGS. 7A and 7B are an oblique view and a front elevation view, respectively, of an actuator adapted to free the lock.
Figure 7B:
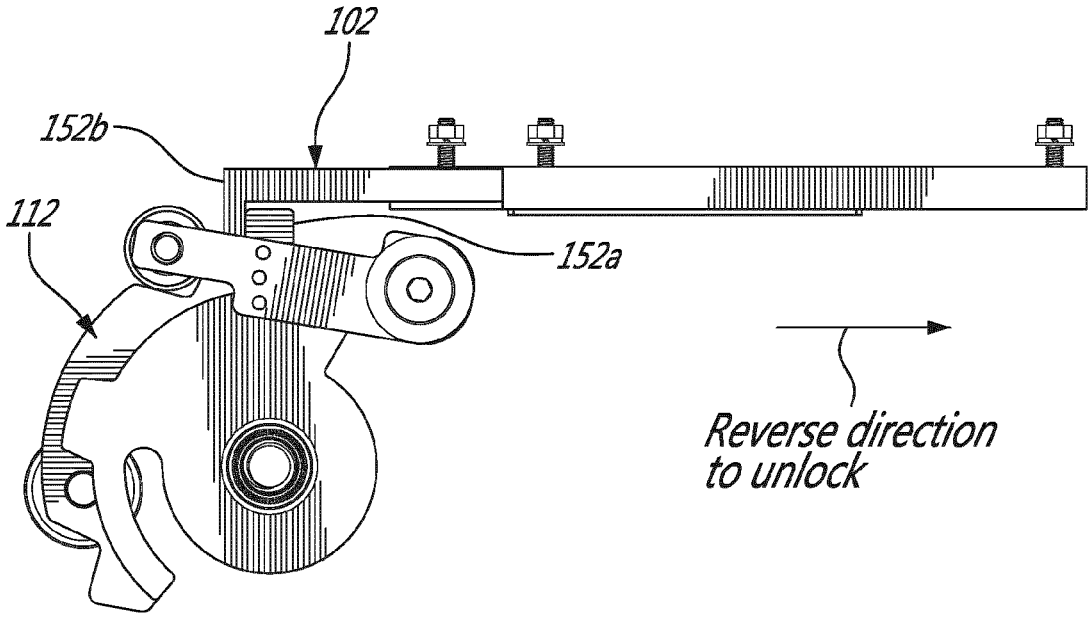

The locking mechanism 110 can be used in combination with an automatic sliding door system (i.e. a sliding door system 100 in which the opening/closing action of the door units 102 is motorized via a linear actuator). In such applications, the force exerted by the linear actuator can be transformed into a pivoting force and transferred to the pivoting member 112, to move the hook member 118 out from the rest area 134 and then move the door unit 102. Such an embodiment is shown in FIGS. 7A and 7B where engaging members 152*a* and 152*b* are provided to effectuate the transfer of movement to the pivoting member 112. In this embodiment, the pivoting member 112 is mounted to the door frame, and the pivoting member 112 is provided with a first one of the engaging members 152*a* and 152*b*. The other one of the engaging members 152*a* and 152*b* is made integral to the door unit 102. When the door unit 102 is locked, both engaging members 152*a* and 152*b* are engaged. When the linear actuator of the door unit 102 is operated, the linear actuator moves the engaging member 152*b* of the door unit 102, which pivots the hook member 118 around the pivot axis 116, out from the rest area, then allowing the door unit 102 to open. In an alternate embodiment, the pivoting member 112 can be provided with a dedicated rotary actuator adapted to pivot the hook member 118 out from the rest area, and the engaging members 152*a* and 152*b* can be omitted, for instance. In still another alternate embodiment, the actuator can be a solenoid attached to the edge of the circular part that will force the rotation when activated.

Figure 8A:
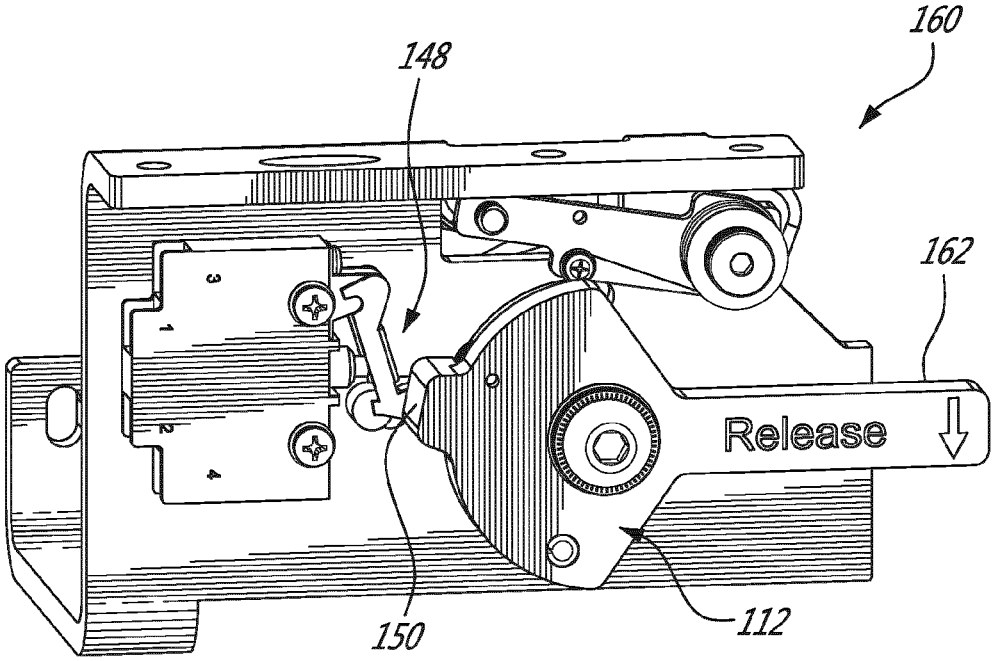
FIG. 8A is an oblique view of an emergency lever adapted to free the lock, in accordance with a first variant.

The locking mechanism 110 can also be provided with a manual unlocking system in addition to or instead of an actuator. Such a manual unlocking system can be provided with a handle directly or indirectly connected to the pivoting member and operable by a user to move the hook member out from the rest area. A first example of a manual unlocking system 160 is provided in FIG. 8A where the handle is in the form of a lever 162 which is directly mounted to the pivoting member 112. The manual unlocking system 160 can be an emergency unlocking system, for instance, and a limit switch 148 can be used to trigger, e.g., using trigger 150 of pivoting member 112, an alarm if the lever 162 is activated in circumstances other than an emergency.

Figure 8B:
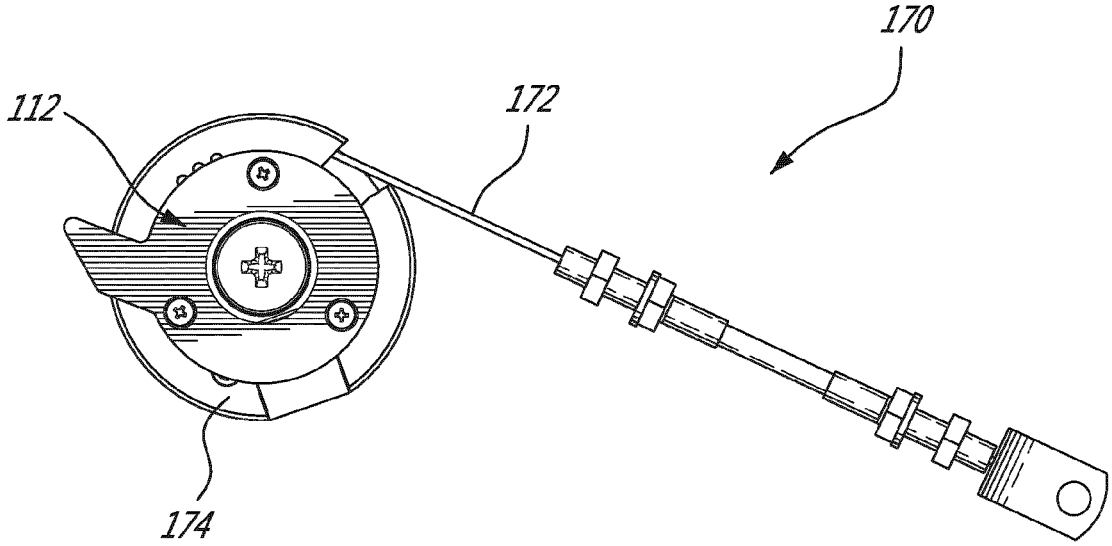
FIG. 8B is a front elevation view of an emergency cable adapted to free the lock, in accordance with a second variant.

A second example of a manual unlocking system 170 is provided in FIG. 8B. In this embodiment, a Bowden cable arrangement is used. A cable 172 is spun around a spool 174 made integral to the pivoting member 112, and the cable 172 extends across a fixture which can lead to a handle (not shown). Pulling the cable 172 rotates the spool 174 and moves the hook member out from the rest area. The pulling of the cable 172 can configured to allow reverse operation of the roller and channel arrangement and to open the door unit to a certain extent. In this manner, a gap can be opened between the door units to an extent sufficient to allow a user to engage his hand in the gap and push the door units open manually, for instance. Similarly, a limit switch can be used to detect unauthorized activation of the manual unlocking system 170. In an embodiment, a manual unlocking system is provided in addition to an automated actuator, the actuator is used during normal use, and the manual unlocking system is used in case of an emergency.

Figure 9:
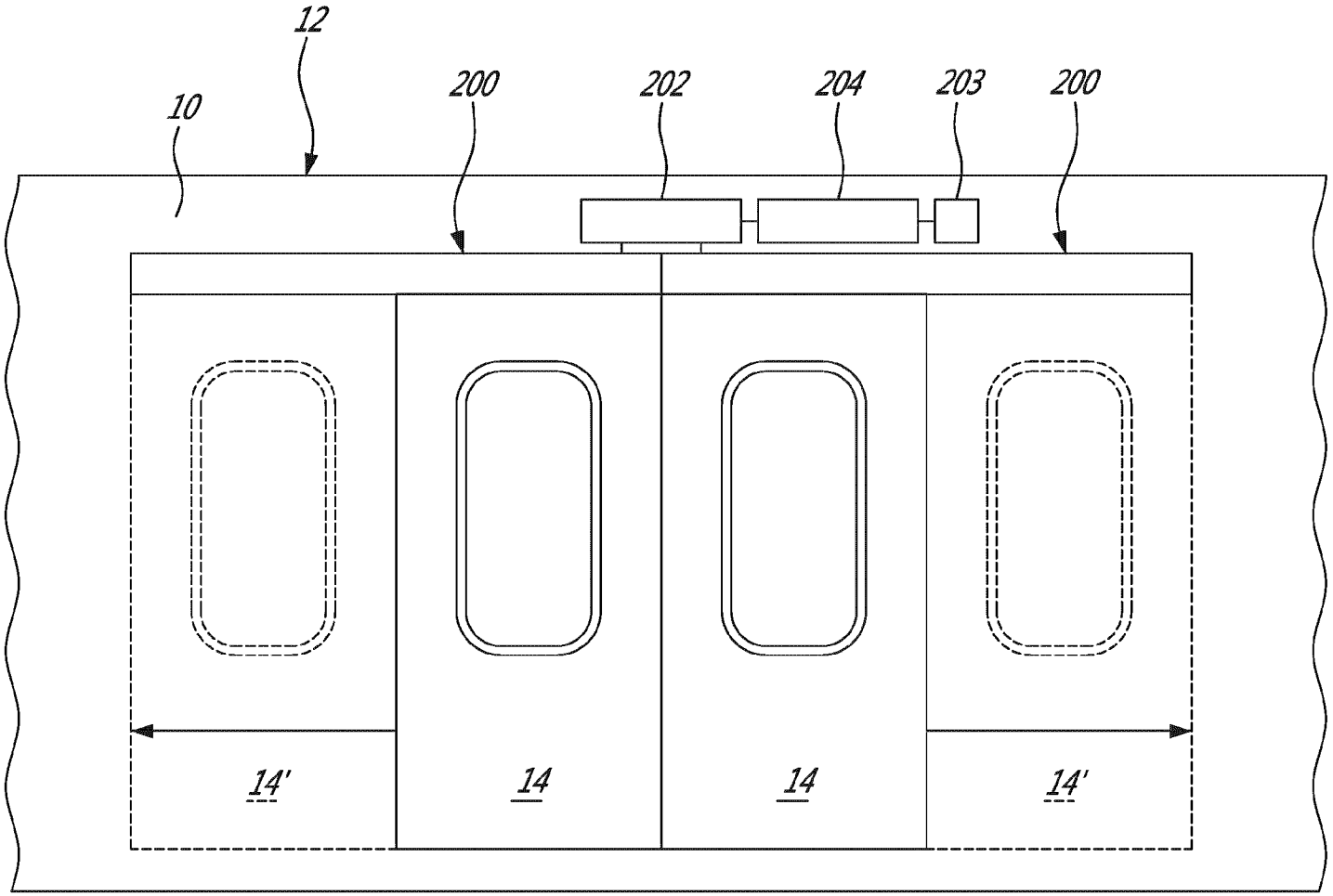
FIG. 9 is another example of a door system, the door system being a double-door system.

With reference to FIG. 9, a specific example embodiment will now be described. FIG. 9 shows a partial side view of the interior of a car body 10 of a transit vehicle 12, e.g., a train. As depicted, at some position along its side, the car body 10 has a double door system including two door units 14 that, when actuated by a respective one of two linear door actuators 200, can allow users to enter and/or exit the transit vehicle at a desired train station. As illustrated, the solid lines show the door units 14 in their respective closed position whereas the dashed lines show door units 14' in their respective open position.

Figure 10:
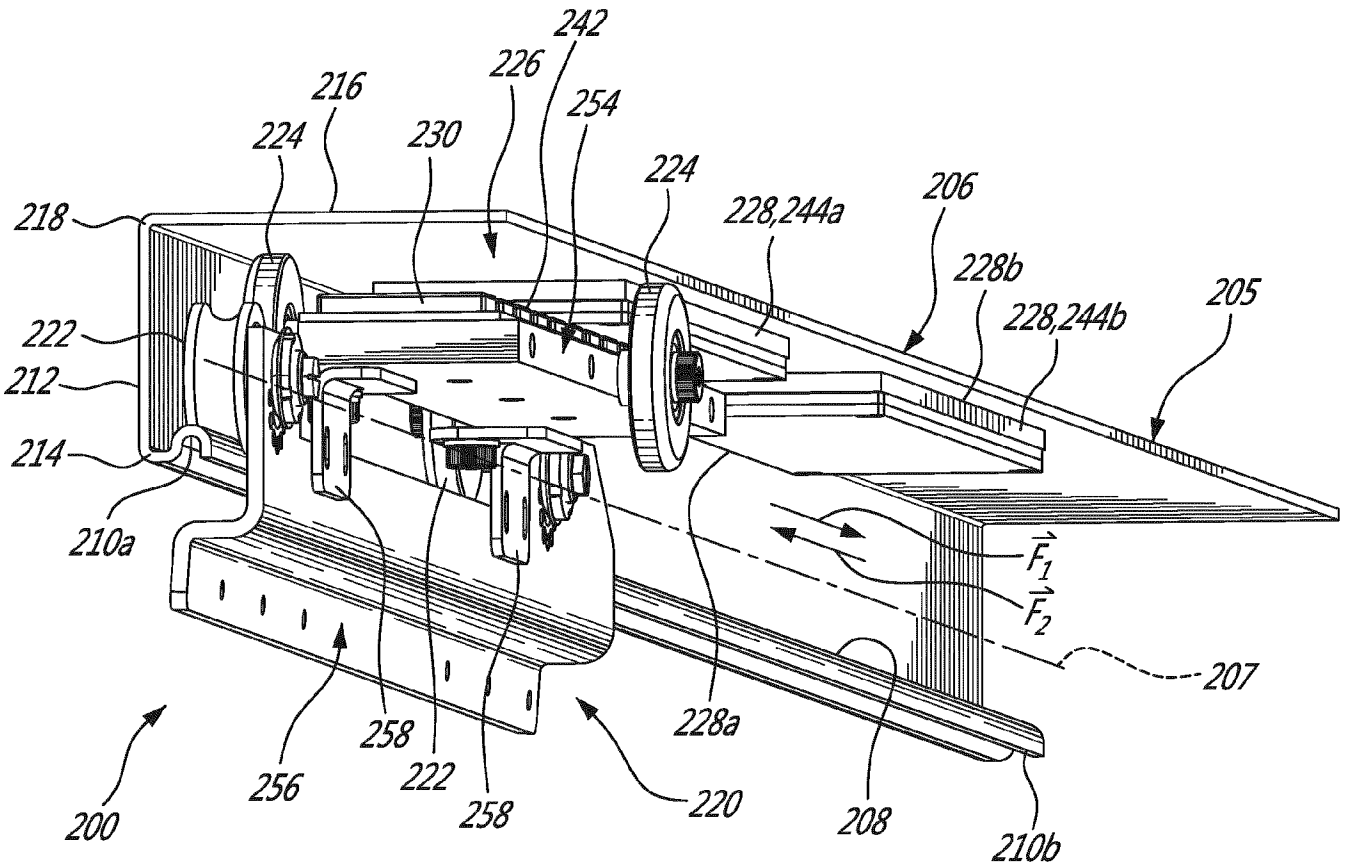
FIGS. 10 and 10A are an oblique view and a side elevation view, respectively, of an example of a linear actuator for operating the door system of FIG. 9.

Referring particularly to FIG. 10, an example of a linear door actuator 200 is shown. As shown, the linear door actuator 200 includes a housing 205 having a receiving structure 206 and a stationary part of a linear induction motor as will be explained below. The receiving structure 206 has a rail 208 extending longitudinally between two ends 210*a* and 210*b* of the rail 208. The receiving structure 206 can thus receive a door carriage 220 via the rail 208 in a manner that the door carriage can be longitudinally moved along a door carriage path 207. The receiving structure 206 has a wall 212 which upwardly extends from a side 214 of the rail 208 and a hood 216 which, in this case, extends perpendicularly from a top 218 of the wall 212 and over the rail 208. In this example, the receiving structure 206 is made of a low magnetic permissibility material such as steel and it may be manufactured using cold forming. In another embodiment, the receiving structure 206 is made of a plurality of parts assembled to one another.

As illustrated, the linear door actuator 200 has an example of a door carriage 220. As it will be understood, the door carriage 220 is trapped within the receiving structure 206 of the housing 205 and is linearly movable therealong. More specifically, the door carriage 220 is movably mounted to the rail 208 of the receiving structure 206 via a first plurality of guide rollers 222 (individually referred to as "first guide roller 222" and collectively referred to as "first guide rollers 222"). The door carriage 220 is also movably mounted to the hood 216 of the receiving structure 206 via a second plurality of guide rollers 224 (individually referred to as "second guide roller 224" and collectively referred to as "second guide rollers 224").

To slide the door carriage 220 back and forth between the two ends 210*a* and 210*b* of the rail 208, the linear door actuator 200 is provided with a linear induction motor 226. The linear induction motor 226 has a stationary part 228 which is mounted to the receiving structure 206 in a manner to extend parallel to the rail 208 and a movable part 230 which is mounted to frame 254 of the door carriage 220.

Figure 10A:
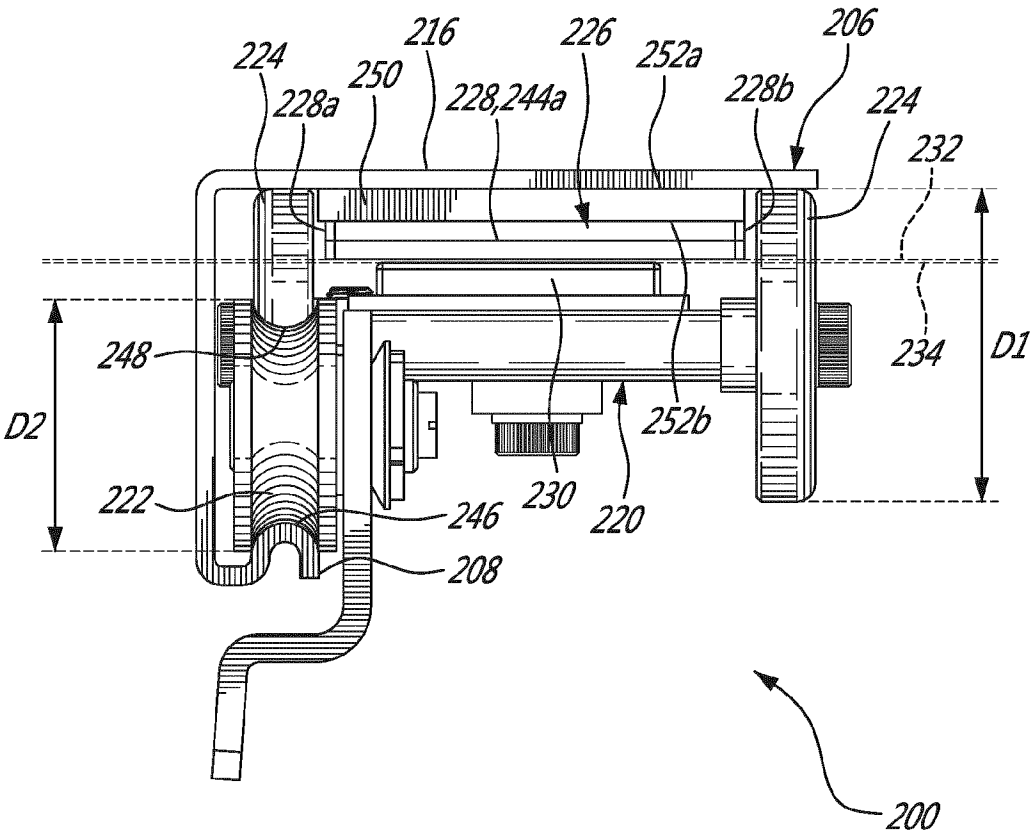

As best seen in FIG. 10A, the stationary part 228 generally defines a first plane 232 whereas the movable part 230 generally defines a second plane 234 parallel to the first plane 232 but slightly offset therefrom. In other words, the stationary part 228 is placed in proximity with the movable part 230 and they are both embedded to the receiving structure 206. For instance, the first and second planes 232 and 234 may be separated by a fraction of an inch.

During use, an electromotive force is generated which causes the movable part 230 to move along the receiving structure 206. Referring back to FIG. 10, the electromotive force can be directed towards a first longitudinal direction F1 along the receiving structure 206 or towards a second, opposite longitudinal direction F2 depending on how the linear induction motor 226 is powered. As may be appreciated, the door carriage 220 is mounted to a door during use (such as the door unit 14 shown in FIG. 9) such that, when the movable part 230 of the linear induction motor 226 moves, the door can move between the closed position and the open position, for instance.

To operate the linear induction motor 226, the linear door actuator 200 has a power supply connected to the linear induction motor 226 and a control system connected to the power supply to control powering of the linear induction motor for moving the door carriage 220 back and forth between the two ends 210*a* and 210*b* of the rail 208. During use, the control system transmits one or more control signals to the power supply which will, based on the control signal, power the linear induction motor 226.

An example of a power supply is shown at 202 in FIG. 9 where an exemplary control system is shown at 204. The power supply 202 can be a three-phase power inverter which converts direct current (DC) to alternating current (AC), and more especially three-phase AC. In this example, the two door actuators 200 are connected to the power supply 202 in a parallel circuit. Depending on the embodiment, the control system 204 is connected to the power supply 202 via a wired connector, a wireless connection, or a combination thereof. Power supply configured to provide DC or a single-phase AC current can also be used. The control system 204 can be in communication with a computer-readable memory 203 having stored thereon a suitable software to operate the power supply. The control system 204 can be provided in the form of a microcontrol system, a processor and the like. The control system 204 can be in communication with a computer-readable memory storing data (e.g. control data), for instance.

Referring to FIG. 10A, the stationary part 228 of the linear induction motor 226 is mounted to the hood 216 of the receiving structure 206, and the second guide rollers 224 are movable along each side 228*a* and 228*b* of the stationary part 228 of the linear induction motor 226. As best seen in FIG. 10, one second guide roller 224 is movable along the side 228*b* of the stationary part 228 (distal from the wall 212) whereas two second guide rollers 224 are movable along the other side 228*a* of the stationary part 228 (proximate the wall 212) of the linear induction motor 226.

Using a total of three second guide rollers 224 can allow more immunity to twisting of the receiving structure 206 compared to a door carriage having four second guide rollers, for instance. As it will be understood, an example of a door actuator can have two, three, four or more than four second guide rollers depending on the circumstances. The number of first guide rollers may also depend on the application. Guide rollers and conventional parts may be purchased from Innovation for Entrance Systems (IFE).

Referring to FIG. 10A, the second guide rollers 224 are provided in the form of wheels each having a first diameter D1 which is larger than a second diameter D2 of the first guide rollers 222. The second guide rollers 224 are configured to prevent upward movement of the door carriage 220 (towards the hood 216).

It was found that providing such second guide rollers 224 can allow to reduce wear and noise during use. Moreover, it was also found that providing such guide rollers 224 that run along each of the sides 228*a* and 228*b* of the stationary part 228 can reduce the need for precision associated with construction of the receiving structure 206. Also, it was found that when the movable part 230 upwardly faces the hood 216, dust is less likely to accumulate on the movable part 230 compared to an embodiment where the movable part 230 laterally faces the wall 212, for instance.

In this example, the stationary part 228 of the linear induction motor 226 has a series of coils longitudinally spaced from one another along the rail 208 of the receiving structure 206, and the movable part 230 of the linear induction motor 226 includes a series of alternate-pole magnets 242. The series of coils are provided in the form of two spaced apart coil assemblies 244*a* and 244*b* each being disposed proximate a respective one of the two ends 210*a* and 210*b* of the rail 208 of the receiving structure 206. In this exemplary configuration, the first plane 232 of the stationary part 228 can be referred to as the "coil assembly plane", and the second plane 234 of the movable part 230 can be referred to as the "magnet plane". It will be understood that, in another embodiment, the stationary part can include a series of alternate-pole magnets longitudinally distributed along the rail of the receiving structure and that the movable part can include a series of longitudinally spaced apart coils.

As best seen in FIG. 10A, the rail 208 has a convex guiding surface 246 whereas the first guide rollers 222 each have a concave surface 248 configured to mate with the convex guiding surface 246 of the rail 208. Similarly, the surface of the second guide rollers 224 has a shape configured to mate with a shape of the hood 216. In the illustrated embodiment, that shape is planar. In another embodiment, the second guide rollers have a concave surface, and the hood is provided with a corresponding convex guiding surface downwardly protruding from the hood to mate with the concave surface of the second guide rollers.

Each coil assembly 244*a*, 244*b* is indirectly mounted to the hood 216 via a back plate 250 made of a low magnetic permissibility material, such as steel. As shown, the steel back plate 250 has a first face 252*a* mounted to the receiving structure 206 and a second face 252*b* mounted to the coil assemblies 244*a* and 244*b*. In an embodiment, the steel back plate may have an antirust treatment.

Referring back to FIG. 10, the door carriage 220 includes a frame 254 to which is mounted the movable part 230 of the linear induction motor 226 and a door hanger 256 mounted to the frame 254 using brackets 258.

Figure 11:
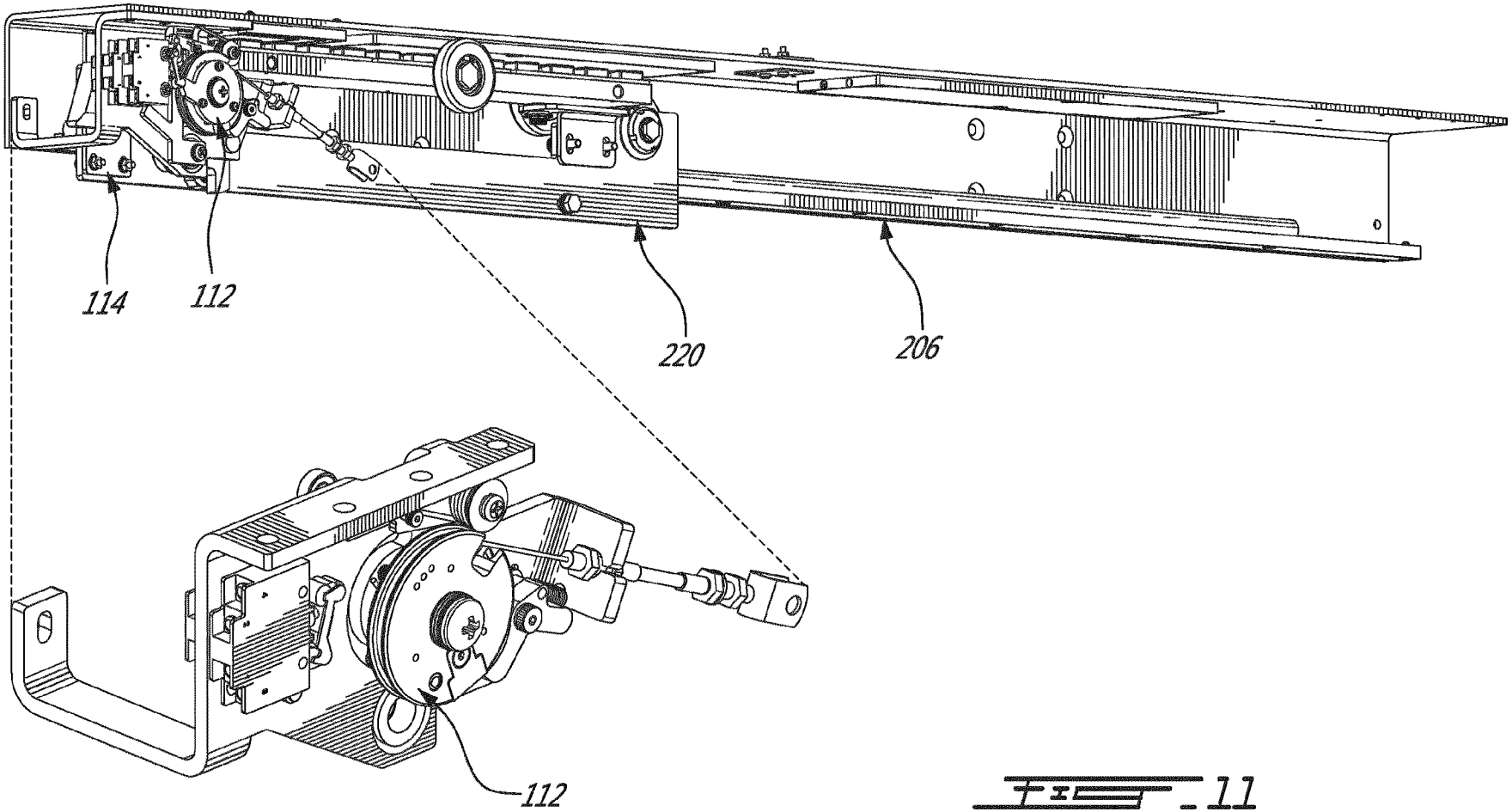
FIG. 11 is an oblique view of the lock system fully assembled.

As shown in FIG. 11, the guide member 114 can be attached to the door carriage 220, which receives the door unit, whereas the pivoting member 112 can be pivotally mounted to the receiving structure 206, which forms part of the door frame.

As can be understood, the examples described above and illustrated are intended to be exemplary only. For instance, a lock system such as described above can be adapted to be used with other sliding door systems, such as elevator door systems, for instance. Moreover, in the embodiment presented above, a roller bearing is used as the hook member to provide a limited amount of friction against the channel member. In alternate embodiments, roller can be another form of male member which slides in the guide and friction can be dealt with in a different manner. For instance, using a guide formed in a low-friction material such as Teflon, and having a smooth shape, for instance, can allow for low-friction sliding engagement between the channel and the male member. Accordingly, the scope is indicated by the appended claims.

What is claimed is:

1. A locking mechanism for a door system, the locking mechanism comprising:

a pivoting member pivotally mounted to one of a door frame and a door unit for pivoting about a pivot axis, wherein the door system includes the door frame and the door unit;

a hook member, which is spaced apart from the pivot axis, wherein the hook member is pivotable about the pivot axis via the pivoting member;

a guide member secured to the other one of the door frame and the door unit, the guide member having a channel formed therein to receive the hook member when the pivoting member is moved toward the guide by the sliding of the door, and wherein the channel maintains engagement with the hook member to force the pivoting of the hook member around the pivot axis passed a position in which the hook member is longitudinally aligned with the pivot axis, and into a rest area of the channel as the door continues to be slid along the door frame, the channel having a sloping face in the rest area which functions as a catch to engage the hook member and force the hook member away from the longitudinally-aligned position when the door is subsequently slid in a reverse direction while the hook member is in the rest area;

wherein the rest area includes and area and the position when the roller has not reached an end of the channel of the guide member, and wherein the hook member is a roller rotatably mounted to the pivoting member about a rotation axis, the rotation axis being parallel and spaced apart from the pivot axis such that the roller can pivot about the pivot axis via the pivoting member.

2. The locking mechanism of claim 1, further comprising:

an actuator operable to pivot the hook member back out from the rest area and across the longitudinally-aligned position in the channel to free the hook member from the sloping face and allow subsequent sliding of the door in the reverse direction.

3. The locking mechanism of claim 1, further comprising:

a handle connected to the pivoting member and manually operable to pivot the hook member back out from the rest area and across the longitudinally-aligned position in the channel to free the hook member from the sloping face and allow subsequent sliding of the door in the reverse direction.

4. The locking mechanism of claim 3, wherein the handle is connected to the pivoting member via a cable coiled around a spool secured to the pivoting member and centered on the pivot axis.

5. The locking mechanism of claim 1, wherein the sloping face is inclined between 85 and 90° from the longitudinal orientation, relative to an axis parallel to the pivot axis, and is located along a radially-inner face of the channel.

6. A locking mechanism for a door system, the locking mechanism comprising:

a pivoting member pivotally mounted to one of a door frame and a door unit for pivoting about a pivot axis, wherein the door system includes the door frame and the door unit;

a hook member, which is spaced apart from the pivot axis, wherein the hook member is pivotable about the pivot axis via the pivoting member;

a guide member secured to the other one of the door frame and the door unit, the guide member having a channel formed therein to receive the hook member when the pivoting member is moved toward the guide by the sliding of the door, and wherein the channel maintains engagement with the hook member to force the pivoting of the hook member around the pivot axis passed a position in which the hook member is longitudinally aligned with the pivot axis, and into a rest area of the channel as the door continues to be slid along the door frame, the channel having a sloping face in the rest area which functions as a catch to engage the hook member and force the hook member away from the longitudinally-aligned position when the door is subsequently slid in a reverse direction while the hook member is in the rest area, wherein the rest area includes and area and the position when the roller has not reached an end of the channel of the guide member; and an actuator operable to pivot the hook member back out from the rest area and across the longitudinally-aligned position in the channel to free the hook member from the sloping face and allow subsequent sliding of the door in the reverse direction;

wherein the actuator includes a linear induction motor operable to drive the sliding movement of the door unit, and engaging members between the door frame and the pivoting member, the engaging members being configured to transfer the sliding movement of the door unit into the pivoting movement moving the hook member back out from the rest area.

7. The locking mechanism of claim 6, further comprising:

a limit switch positioned to be triggered when the hook member engages the rest area.

8. A locking mechanism for a door system, the locking mechanism comprising:

a pivoting member pivotally mounted to one of a door frame and a door unit for pivoting about a pivot axis, wherein the door system includes the door frame and the door unit;

a hook member, which is spaced apart from the pivot axis, wherein the hook member is pivotable about the pivot axis via the pivoting member;

a guide member secured to the other one of the door frame and the door unit, the guide member having a channel formed therein to receive the hook member when the pivoting member is moved toward the guide by the sliding of the door, and wherein the channel maintains engagement with the hook member to force the pivoting of the hook member around the pivot axis passed a position in which the hook member is longitudinally aligned with the pivot axis, and into a rest area of the channel as the door continues to be slid along the door frame, the channel having a sloping face in the rest area which functions as a catch to engage the hook member and force the hook member away from the longitudinally-aligned position when the door is subsequently slid in a reverse direction while the hook member is in the rest area, wherein the rest area includes and area and the position when the roller has not reached an end of the channel of the guide member;

a handle connected to the pivoting member and manually operable to pivot the hook member back out from the rest area and across the longitudinally-aligned position in the channel to free the hook member from the sloping face and allow subsequent sliding of the door in the reverse direction; and a limit switch positioned to be triggered upon activation of the handle.

9. The locking mechanism of claim 8, wherein the limit switch is connected to one of an alarm and a control system adapted to control the sliding of the door.

10. A locking mechanism for a door system, the locking mechanism comprising:

a pivoting member pivotally mounted to one of a door frame and a door unit for pivoting about a pivot axis, wherein the door system includes the door frame and the door unit;

a hook member, which is spaced apart from the pivot axis, wherein the hook member is pivotable about the pivot axis via the pivoting member;

a guide member secured to the other one of the door frame and the door unit, the guide member having a channel formed therein to receive the hook member when the pivoting member is moved toward the guide by the sliding of the door, and wherein the channel maintains engagement with the hook member to force the pivoting of the hook member around the pivot axis passed a position in which the hook member is longitudinally aligned with the pivot axis, and into a rest area of the channel as the door continues to be slid along the door frame, the channel having a sloping face in the rest area which functions as a catch to engage the hook member and force the hook member away from the longitudinally-aligned position when the door is subsequently slid in a reverse direction while the hook member is in the rest area, wherein the rest area includes and area and the position when the roller has not reached an end of the channel of the guide member, and wherein the pivoting member has an arcuate guide face having at least one notch; and a biasing roller spring-biased against the arcuate guide face, the biasing roller engaging a respective one of the at least one notch when the hook member is in the rest area, to bias the hook member in the corresponding circumferential position.

11. A locking mechanism for a door system, the locking mechanism comprising:

a pivoting member pivotally mounted to one of a door frame and a door unit for pivoting about a pivot axis, wherein the door system includes the door frame and the door unit;

a hook member, which is spaced apart from the pivot axis, wherein the hook member is pivotable about the pivot axis via the pivoting member;

a guide member secured to the other one of the door frame and the door unit, the guide member having a channel formed therein to receive the hook member when the pivoting member is moved toward the guide by the sliding of the door, and wherein the channel maintains engagement with the hook member to force the pivoting of the hook member around the pivot axis passed a position in which the hook member is longitudinally aligned with the pivot axis, and into a rest area of the channel as the door continues to be slid along the door frame, the channel having a sloping face in the rest area which functions as a catch to engage the hook member and force the hook member away from the longitudinally-aligned position when the door is subsequently slid in a reverse direction while the hook member is in the rest area, wherein the rest area includes and area and the position when the roller has not reached an end of the channel of the guide member, and wherein the pivoting member has an arcuate guide face having at least one notch; and a biasing roller spring-biased against the arcuate guide face, the biasing roller engaging a respective one of the at least one notch when the hook member is outside the channel, to bias the hook member in the corresponding circumferential position.

* * * * *